US005857922A

United States Patent [19]

Delio

[11] Patent Number: 5,857,922

[45] Date of Patent: Jan. 12, 1999

[54] GOLF PUTTING CLUB

[76] Inventor: Ralph D. Delio, RD #1 Susan Trace, New Wilmington, Pa. 16142

[21] Appl. No.: 918,350

[22] Filed: Aug. 26, 1997

Related U.S. Application Data

[63] Continuation-in-part of Ser. No. 917,580, Apr. 25, 1997, abandoned, which is a continuation-in-part of Ser. No. 778,970, Jan. 6, 1997, abandoned.

[51] Int. Cl.[6] ..... A63B 53/04

[52] U.S. Cl. ..... 473/313; 473/330; 473/341

[58] Field of Search ..... 473/324, 330, 473/331, 305, 313, 314, 340, 341, 342, 349, 350, 251, 255, 245, 246

[56] References Cited

U.S. PATENT DOCUMENTS

| | | | |
|---|---|---|---|
| D. 217,373 | 4/1970 | Zitko | 473/255 |
| D. 228,003 | 7/1973 | Warner | 473/255 |
| 656,099 | 8/1900 | Dunn | 473/330 |
| 1,467,714 | 9/1923 | Doerr | 473/330 |
| 1,525,137 | 2/1925 | Lawton | 437/330 |
| 3,989,257 | 11/1976 | Barr | 473/330 |
| 4,077,633 | 3/1978 | Studen | 473/340 |
| 4,162,074 | 7/1979 | Thomson | 473/330 |
| 4,664,385 | 5/1987 | Macera . | |
| 4,795,158 | 1/1989 | Kuykendall | 473/340 |
| 4,852,879 | 8/1989 | Collins | 473/313 |
| 4,917,384 | 4/1990 | Caiati | 473/330 |
| 5,098,103 | 3/1992 | Mackeil | 473/330 |
| 5,303,923 | 4/1994 | Garcia | 473/330 |
| 5,333,873 | 8/1994 | Burke | 473/330 |
| 5,344,149 | 9/1994 | Miller | 473/330 |
| 5,382,019 | 1/1995 | Sneed | 473/330 |

*Primary Examiner*—Sebastiano Passaniti
*Attorney, Agent, or Firm*—Titus & McConomy LLP

[57] ABSTRACT

The present invention generally comprises a golf putter having a putting surface with a negative loft angle of about −10° to −2°. The putter surface strikes the ball at approximately the center of gravity of the club and above the vertical centerline of the ball, imparting overspin and eliminating the tendency for the ball to skid, bump or become airborne. The negative loft angle is such that the putter face contacts the ball above the centerline with each stroke, imparting topspin on the ball 100% of the time, independent of variable putting conditions. An alternate preferred embodiment of the present invention combines the negative loft putting face with a convex putting surface as circumscribed by arc of radius at least 5 inches and at most 84 inches. This convex putting surface is designed to minimize the trajectory errors caused by planar face putters by producing a ball trajectory which in most cases reduces the misalignment created by a nonzero contact angle between the ball and the putter face. In other words, if the angle of contact with putter face of the present invention is misaligned by 1 degree from that which would produce a straight line trajectory to the hole, the ball will travel a path that is less than or equal to 1 degree to the right or left of the hole, thus producing a more accurate alignment with the hole.

24 Claims, 3 Drawing Sheets

FIG. 1
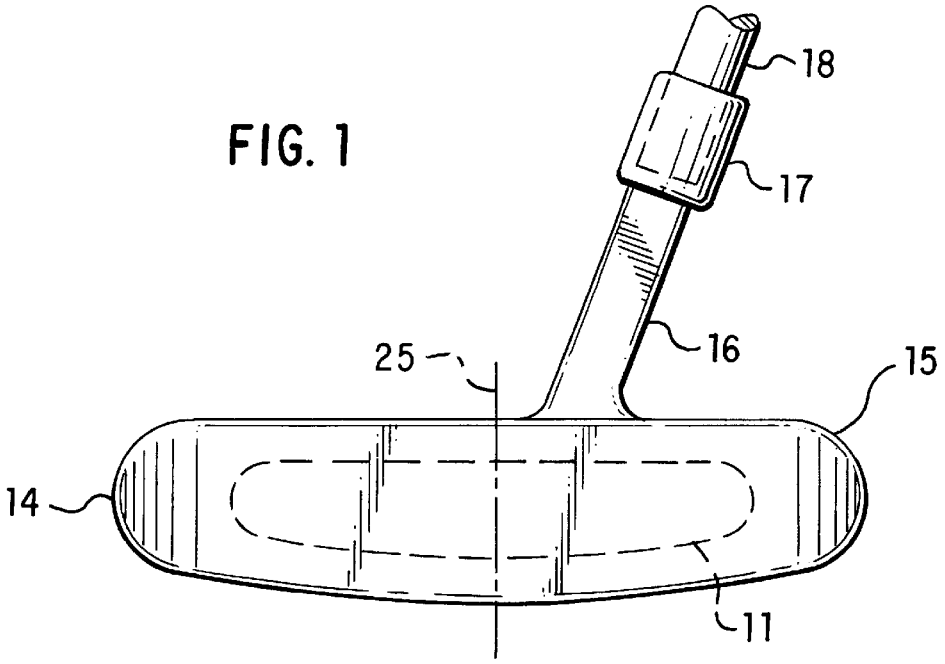
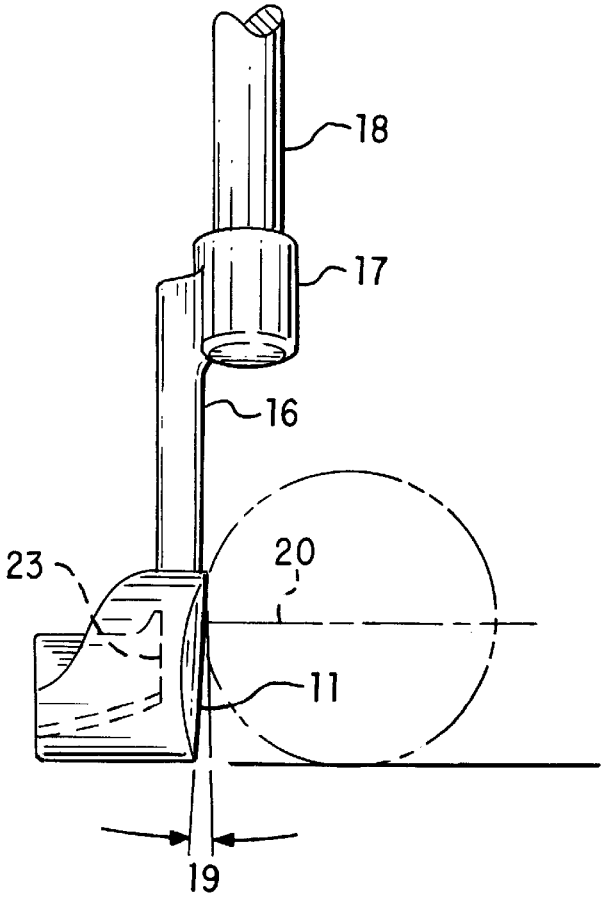
FIG. 2

FIG. 5
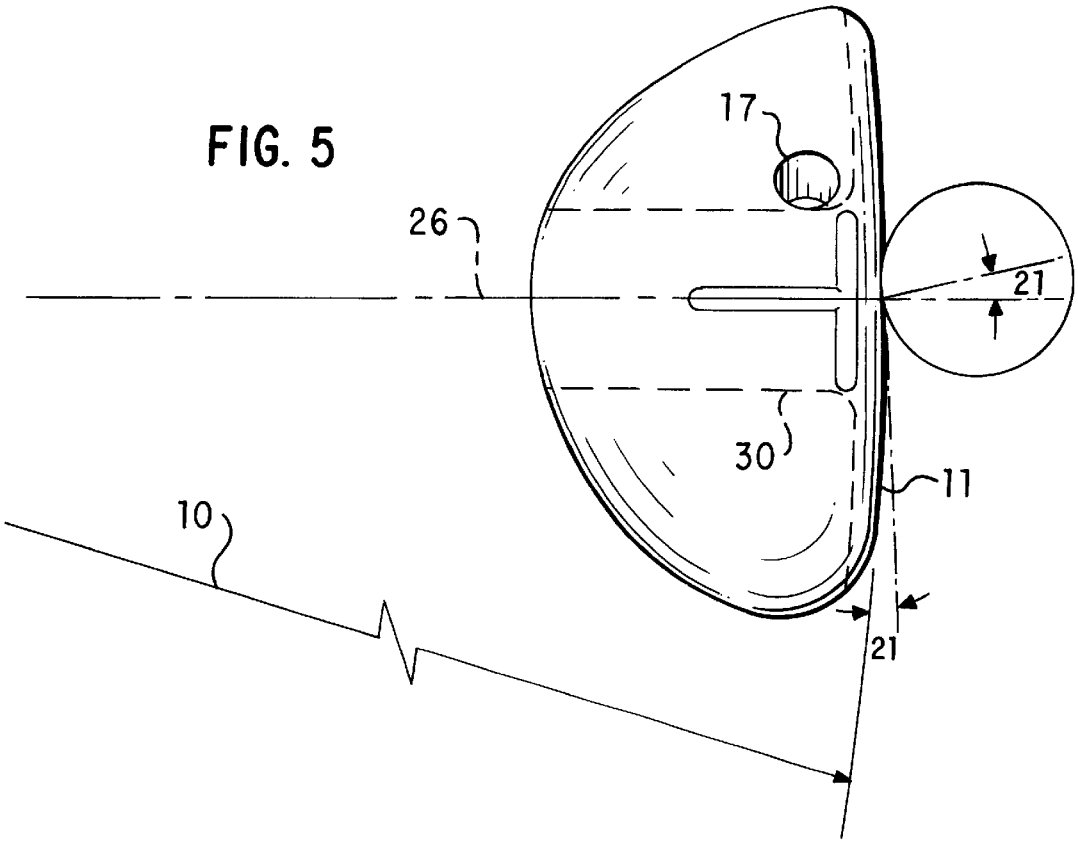
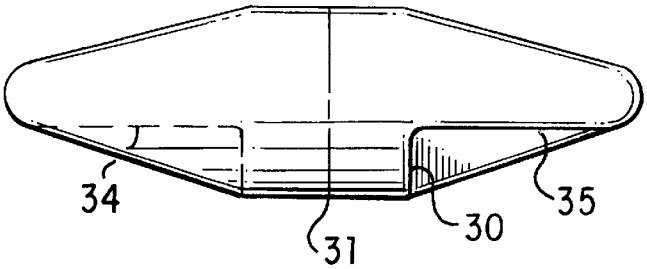
FIG. 6
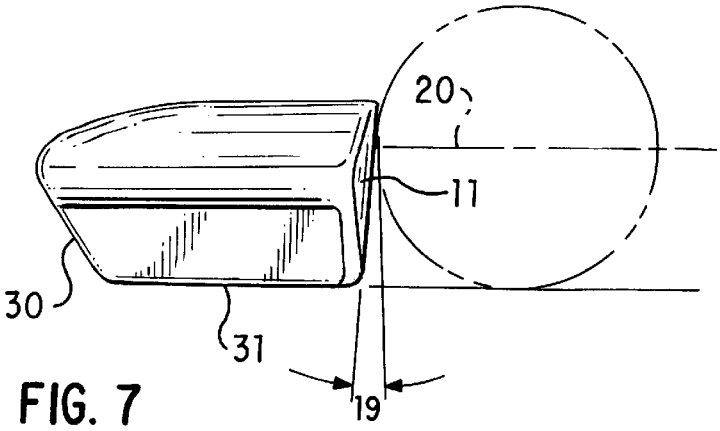
FIG. 7

GOLF PUTTING CLUB

CROSS-REFERENCE

This application is a continuation-in-part (CIP) of U.S. patent application Ser. No. 08/917,580 filed Apr. 25, 1997 for a Golf Putting Club, which is a continuation-in-part (CIP) of U.S. patent application Ser. No. 08/778,970, for a "Golf Putting Club" which was filed on Jan. 6, 1997, both abandoned.

FIELD OF THE INVENTION

This invention relates to golf putting clubs, and in particular to a putter having a negatively lofted putting surface for providing top spin to a golf ball, and also to a putter having a convex putting surface for minimizing the amount of angular displacement of a golf ball that is struck on an angle to the central axis of the putter face.

BACKGROUND OF THE INVENTION

Due to the increased popularity of the game of golf as a recreational and professional sport over the past several years, a need has arisen for a golf putting club that provides golfers of all skill levels with the opportunity to maximize putting performance. As a result, golf club manufacturers have begun introducing putters that are designed to minimize the adverse effects of errors in putting technique. One aspect of this effort has been to introduce a putter with modifications designed to create topspin on the golf ball as it is struck by the putter head. Because of the frictional forces created by the roll of the ball on the ground, the optimal putt is one in which the ball is provided with consistent overspin for accuracy and speed.

Most conventional putters have a flat face with a positive loft that contacts the golf ball at the tangent point below the center of the ball. The average golf ball is 1.66 inches in diameter, thus placing the centerline 0.83 inches from the ground, (not considering the height of the grass, etc.). Although the height of the putter face is usually larger than 0.83 inches, the ball must nevertheless always be contacted at the above-described tangent point which intersects the centerline of the ball, since the non-angled putter face or positive angled lies in a plane perpendicular to the ground or below the centerline of the ball. Because this contact point lies on and not above the centerline of the ball, overspin will not always be created when the club face strikes the ball, and as a result the ball will sometimes "skid", "bump", or sometimes even become airborne, depending on the length of the putt, length and direction of the grain of the grass.

Considering all the variables beyond the golfer's control which can affect the line and speed a putt, and considering the change in these variables which results from the differing conditions encountered at each different green on each different day, it is evident that a need exists for a putter which can minimize the adverse effects of some of these variables regardless of the conditions encountered. Providing a putter which imparts consistent overspin to the ball will accomplish this by eliminating the tendency for the ball to skid, bump or become airborne. The present invention solves this problem by providing a negatively angled loft on the face of the putter, as contrasted with the non-angled club face of most conventional putters the positively angled club face loft of most conventional golf irons. This negative loft allows the putter face to contact the ball above the centerline with each stroke, imparting topspin on the ball 100% of the time, independent of most variable putting conditions.

One putter that makes the claim of producing topspin is the "Masteroll" Putter found in the September 1995 issue of the Competitive Edge Golf Magazine (at page 10). This putter is round with a larger diameter than the ball, and does create overspin, but the effectiveness of the putter is dependent on some conditions being ideal. For example, if the length of grass varies, so does the quality of overspin produced by this putter, due to a variation in the point on the club face at which the club contacts the ball. Because the putter has a rounded vertical cross-section along the club face, this variation in the contact point will not eliminate the tendency of the ball to "climb" to overcome the friction opposing its roll. Although its overall performance is better than in many conventional designs, because of this putter's rounded club face a consistent repeatable overspin will not be provided to the putt, resulting in some degree of bumping and skidding in the putt.

Another putter that makes the claim of producing topspin is a putter that creates "rounder rolls", as again shown in the September 1995 issue of the Competitive Edge Golf Magazine (at page 19). This putter is claimed to always strike the ball above the ball's center of gravity. However, due to the fact that most conventional golf balls have a lighter half and a heavier half, this will not always be the case, depending on which half of the ball is oriented nearer to the ground when struck by the club face. (See September 1995 issue of Competitive Edge Golf Magazine, at page 22). Thus, ideal conditions must also exist (or an inertial mass-balanced golf ball must be used) for topspin to be consistently produced with this putter.

There are a number of negative loft putters disclosed in the prior art, including U.S. Pat. Nos. 5,344,149; 5,407,196; 4,664,385; 1,467,714; 4,795,158; D204,279; 5,348,301; 3,333,854 and 4,881,739. However, all of these putters have a planar face, which results in an exaggerated off-center trajectory for the ball, if the angle of contact of the putter face is adjusted to cause the ball to travel a non-straight line path to the hole to account for a sloping green. With a conventional planar putter face, the golf ball will travel a path which is approximately 1.71 (or $1\frac{5}{7}$) times more angularly skewed than the putter face angle of contact. In other words, if the angle of contact with conventional planar putter face is intentionally or accidentally misaligned by 1 degree from that which would produce a straight line trajectory to the hole, the ball will travel a path that is approximately 1.71 degrees to the right or left of the hole. The present invention minimizes this trajectory error by providing a putting face which is convex on an arc of radius 5 to 84 inches. This convexity will produce a ball trajectory which is at most equal to the putter face contact angle misalignment, and in most cases will in fact reduce this misalignment to be less than that created by the putter face. In other words, if the angle of contact with putter face of the present invention is misaligned by 1 degree from that which would produce a straight line trajectory to the hole, the ball will travel a path that is less than or equal to 1 degree to the right or left of the hole, thus producing a more accurate alignment with the hole.

A putter with an angled face is disclosed in U.S. Pat. No. 5,382,019. However, the radius of curvature for this club face lies in the same plane as the axis and centerline of the ball, and therefore will not provide the claimed topspin feature 100% of the time, since the ball must be struck on the upswing to produce the overspin effect. Additionally, the shape of the putter face disclosed in U.S. Pat. No. 5,382,019 makes it difficult for the golfer to line himself up at right angles to the hole, since from the golfer's view, the putter face provides no visual indicator with which to gauge hole-to-ball alignment. Thus, unless the ball is struck at the exact geometric center of the putter face, a tangential trajectory similar to that described above will result, causing an unintended deviation in the path of travel of the ball to the hole.

Thus, it is an object of the present invention to provide a golf putting club having a negatively lofted putting surface for providing top spin to a golf ball.

It is a further object of the present invention to provide a golf putting club having a convex putting surface for minimizing the amount of angular displacement of a golf ball that is struck on an angle to the central axis of the putter face.

It is a further object of the present invention to provide a golf putting club which contacts the golf ball above the centerline to impart topspin on every putting stroke, independent of variable putting conditions.

It is a further object of the present invention to provide a golf putting club having a convex club face for producing a ball trajectory which is at most equal to the contact angle deviation created by misalignment of the putter face, and which will ideally reduce the amount of angular misalignment created by the putter face.

SUMMARY OF THE INVENTION

The present invention generally comprises a golf putter having a putting surface with a negative loft angle of about −10° to −2°. The putter surface strikes the ball at approximately the center of gravity of the club and above the vertical centerline of the ball, imparting overspin and eliminating the tendency for the ball to skid, bump or become airborne. The negative loft angle is such that the putter face contacts the ball above the centerline with each stroke, imparting topspin on the ball 100% of the time, independent of variable putting conditions.

An alternate preferred embodiment of the present invention combines the negative loft putting face with a convex putting surface as circumscribed by arc of radius at least 5 inches and at most 84 inches. This convex putting surface is designed to minimize the trajectory errors caused by planar face putters by producing a ball trajectory which in most cases reduces the misalignment created by a nonzero contact angle between the ball and the putter face. In other words, if the angle of contact with putter face of the present invention is misaligned by 1 degree from that which would produce a straight line trajectory to the hole, the ball will travel a path that is less than or equal to 1 degree to the right or left of the hole, thus producing a more accurate alignment with the hole.

The putters shown are right handed, and it is understood that they also could be left handed.

Other advantages of the present invention will become apparent from a perusal of the following detailed description of a presently preferred embodiment when taken in connection with the accompanying drawings.

BRIEF DESCRIPTION OF THE DETAILED DRAWINGS

FIG. 1 is an elevation view of the preferred embodiment of the present invention, showing the front face of the putter.

FIG. 2 is an elevation view of the preferred embodiment of the present invention, showing the negatively sloped putter face from the toe of the putter.

FIG. 5 is a top plan view of an alternate embodiment of the present invention, showing a mallet-type putter with a convex putter face.

FIG. 6 is a rear view of the mallet-type putter.

FIG. 7 is a side view of the mallet-type putter, showing the negatively lofted putting surface with a golf ball in striking position.

DETAILED DESCRIPTION OF THE PRESENTLY PREFERRED EMBODIMENTS

Figure 3:
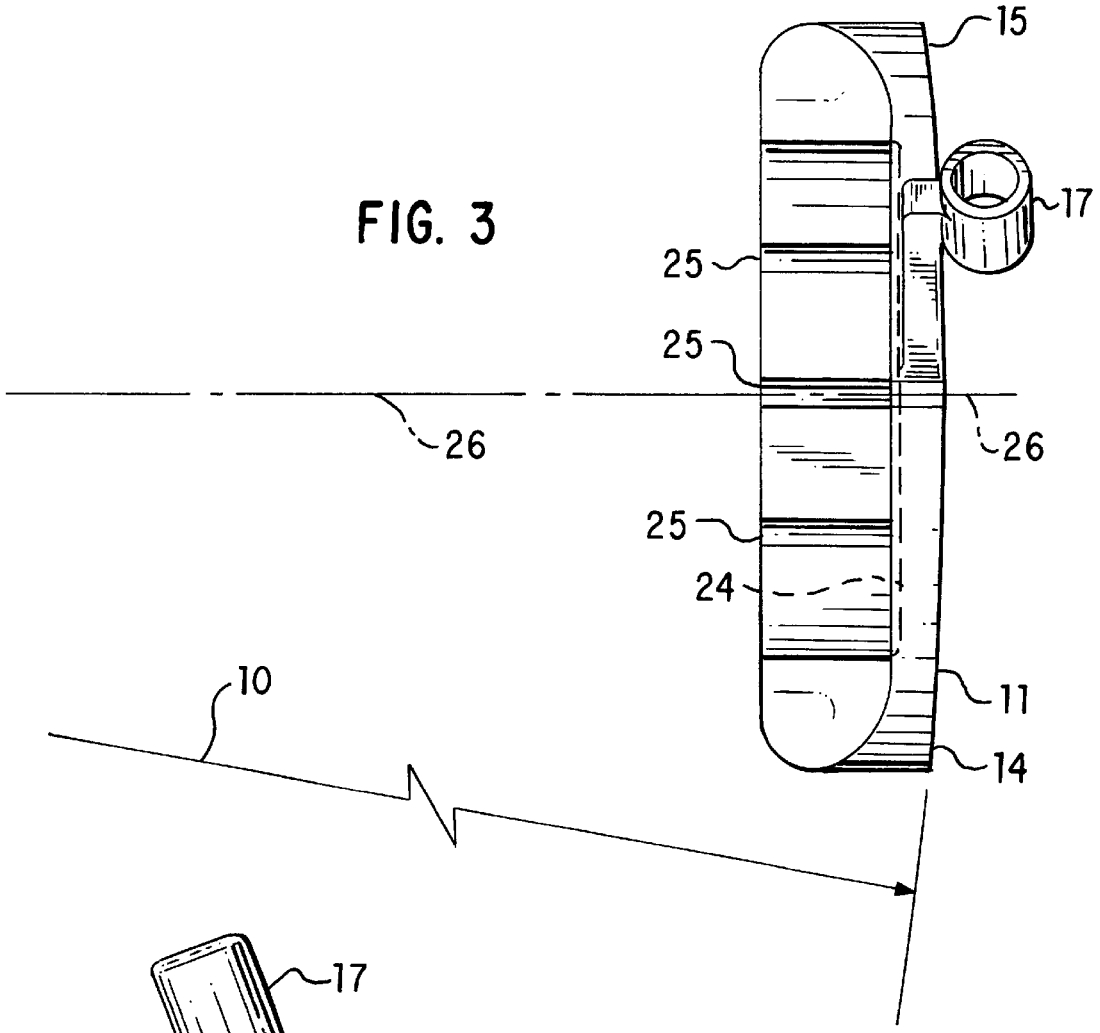
FIG. 3 is a top plan view of the preferred embodiment of the present invention, showing a convex putter face.
Figure 4:
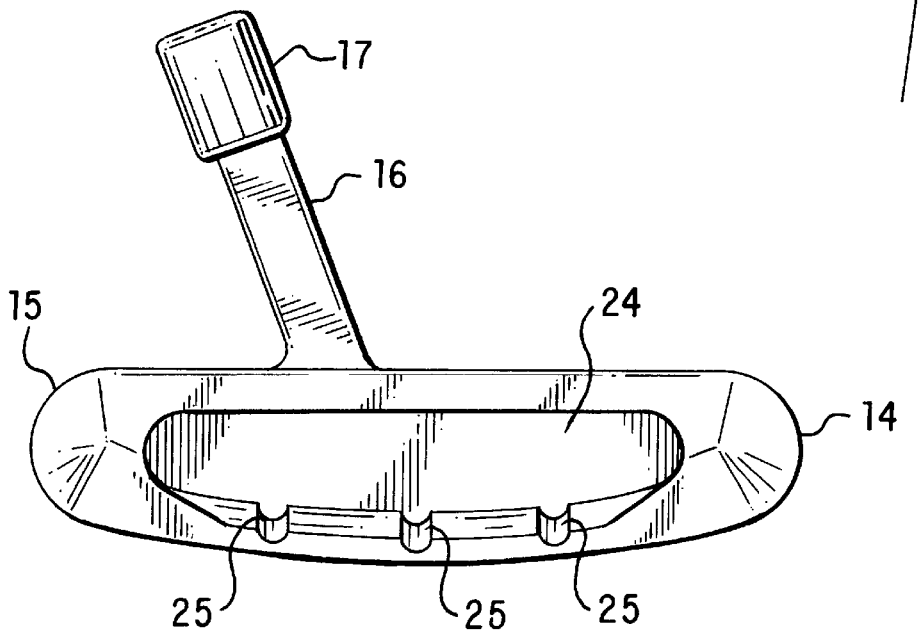
FIG. 4 is an elevation view of the preferred embodiment of the present invention, showing the rear of the putter.

In the drawing FIG. 1 is a front view of the preferred embodiment of the present invention, showing a putting surface 11 having a toe portion 14 and a heel portion 15, with a shaft 16 and a hosel 17 in which is secured a handle 18 that extends about 3 feet in length. The shaft 16 and hosel 17 support the putter at a point near the center of gravity to minimize the torque on the putter caused by a shot generated between the center of gravity and either the heel 15 or the toe 14 of the club. FIGS. 3 and 4 show the top and rear of the putter, respectively. The putter hitting surface 11 is convex on an arc 10 varying between 5 inches to 84 inches in radius. The advantage of this convex hitting surface will be explained in detail. The rear side of the putter is hollow and has three grooves 25. As is shown in FIG. 3, the center of gravity of the putter and the center of the hitting surface 11 both lie on line 26 and a line 24 may be added to the rear side of the putter, running generally parallel to the putter face 11, to assist in aligning the putter face squarely to the hole. As seen in FIG. 2, the rear of the putter is hollow as shown at 23 but the toe 14 and heel 15 are solid. The putter face 11 can be smooth or can be made rough, as with sandblasting or CNC milling, to give more overspin action for some types of grass.

The total length of the putter is approximately 4⅜ inches, while the total weight is approximately 305–310 grams. Most of the weight is concentrated in the heel 15 and toe 14 such that the center of mass is at a point 1.75 inches from either end of the putter, with a weight of 34 grams. This gives a moment of inertia 104.125 grams per square inch from either side of the vertical centerline of the putter 25, which provides high resistance to the creation of torque by off-center hits. The putter height is approximately 1.09 inches, being designed at least 0.25 inches higher than the 0.83 inch height of the ball horizontal centerline 20, which is the line running parallel to the ground and passing through the center of the ball. The center of gravity of the putter is approximately at the center of the club head, at a point approximately 0.82 inches from the bottom of the putter. The putter is designed to strike the ball at approximately 0.02 inches above the ground, which results in the center of gravity being just above the ball centerline 20 at impact, due to the average 0.83 inch ball radius. The hosel 17 is angled at 17–20 degrees from vertical, along a line that intersects the vertical centerline of the putter 25 at the bottom of the club.

FIG. 5 shows a top view of a mallet-type putter having a hitting surface 11 which is convex on an arc 10 varying between 5 inches to 84 inches in radius. The horizontal centerline of the striking surface is seen at 26 and the hosel opening at 17. As shown in FIG. 6, the mallet is supported at 30 with flat portions 34 and 35 on either side. The weight of the mallet is approximately 310 grams and is made of solid ZA-12, which is a mix of approximately 70% aluminum and 30% zinc. This material provides a softer "feel" at club contact with the ball. The center of gravity is again approximately in the center of the club head, at a point approximately 0.82 inches from the bottom of the putter. The mass of this putter head is concentrated in an area bounded at ½ inch from either side of the centerline, providing a larger "sweet spot" conventional mallet-type clubs. As a result, a large backswing is not required, thus lessening the error caused by off-center and/or open faced hits. Finally, the "T" top of the putter head provides a means of aligning the putter head to the hole. With both designs, it is easy to lineup the hole at right angle to the clubface assuring correct hole alignment.

FIGS. 2 and 7 show a view of the putter from the toe of the club showing the engagement with a golf ball as it is being hit. The ball is approximately 1.66 inches in diameter and the putter face has a negative loft angle 19 of about −10° to −2°. The putter surface 11 strikes the ball at approximately the center of gravity of the club head and above the centerline 20, imparting overspin and eliminating the tendency for the ball to skid, bump or become airborne. This negative loft angle 19 allows the putter face 11 to contact the ball above the centerline 20 with each stroke, imparting topspin on the ball 100% of the time, independent of most variable putting conditions.

The present invention combines the negative loft putting face 11 with a convex putting surface as circumscribed by arc 10 of radius at least 5 inches and at most 84 inches, as seen in FIGS. 3 and 5. This convex putting surface is designed to minimize the trajectory errors caused by planar face putters by producing a ball trajectory which in most cases reduces the misalignment created by a nonzero contact angle 21 between the ball and the putter face 11. In other words, if the angle of contact with putter face of the present invention is misaligned by 1 degree from that which would produce a straight line trajectory to the hole, the ball will travel a path that is less than or equal to 1 degree to the right or left of the hole, thus producing a more accurate alignment with the hole. The arc 10 radius can optionally be made much larger than that found on drivers, since less correction is required for a putter head that is traveling at approximately 5 miles per hour on average, as compared to a driver that is traveling at approximately 100 miles per hour.

In contrast, a conventional planar face putter results in an exaggerated off-center trajectory for the ball, causing the ball to travel a path which is approximately 1.71 (or 1⅔) times more angularly skewed than the putter face angle of contact. In other words, if the angle of contact with conventional planar putter face is intentionally or accidentally misaligned by 1 degree from that which would produce a straight line trajectory to the hole, the ball will travel a path that is approximately 1.71 degrees to the right or left of the hole.[1] As described above, using the putter of the present invention on the same putt, the path of the ball would be off-center less than one degree in the same direction, thus reducing the overall angular displacement trajectory error by over 50%.

[1] Prey, Theodore, Jorgensen Publication, N.Y., N.Y., AIP Press, 1993. See Technical Appendix 3, at pages 123–131.

The putter of the present invention was tested for these features using a tripod with an axle rotating parallel to the club face with minimal friction, and a clamp that accepted the putter by the grip. The putter of the present invention was compared to a conventional straight-faced non-negative loft putter by aligning the putters first at an exact right angle to the hole, and then with open and closed faces varying at angles from one to six degrees. It was found that the convex face of the present invention corrects the trajectory error by approximately 50%, while the overspin on the ball produced by the present invention eliminates the approximately 20% skidding and bumping inherent in conventional putters, causing the ball to the ball roll straighter and further with the same stroke.

While presently preferred embodiments of the invention have been show and described in particularity, it may be otherwise embodied within the scope of the appended claims.

What is claimed is:

1. A golf putting club comprising a club head having a negatively sloped convex putting surface having a continuous negative slope from a top portion to a bottom portion of said putting surface for creating topspin on a golf ball as a ball is struck by said putting surface, said club being configured for reducing the angular trajectory of a ball as a ball is struck by said putting surface at a point spaced a horizontal distance from the center of gravity of said club head.

2. The golf putting club of claim 1, wherein said negative slope is between approximately 2 degrees and 10 degrees when measured from the vertical.

3. The golf putting club of claim 1, wherein said putting surface is configured to strike a ball at a point above the horizontal centerline of a ball when said club head and a ball are placed on a putting surface in the address position.

4. The golf putting club of claim 1, wherein said putting surface is configured to strike a ball at the approximate center of gravity of said club club head when said club head and a ball are placed on a putting surface in the address position.

5. The golf putting club of claim 1, wherein the center of gravity of said club head lies at a point further from the ground than the horizontal centerline of a ball.

6. The golf putting club of claim 1, wherein the top of said putting surface lies at a point further from the ground than the horizontal centerline of a ball.

7. The golf putting club of claim 1, wherein of said club has its weight concentrated at opposite longitudinal ends of said club head such as to create moment of inertia which imparts a high resistance to torque generated by the striking of a ball by said putting surface.

8. The golf putting club of claim 1, further comprising a shaft angled from a plane oriented perpendicular to the striking surface and containing the vertical centerline of said club head.

9. The golf putting club of claim 8, wherein said shaft intersects said vertical centerline.

10. The golf putting club of claim 8, wherein said angle is between 17 and 20 degrees.

11. The golf putting club of claim 1, wherein a portion of said club head opposite said putting surface is hollow.

12. The golf putting club of claim 1, wherein said club head is mallet shaped.

13. The golf putting club of claim 12, wherein said club has a mass concentrated in an area bounded by an equal distance extending horizontally in both directions from the vertical centerline of said club.

14. The golf putting club of claim 13, wherein said distance is approximately one-half inch.

15. The golf putting club of claim 12, wherein said club is shaped in the form of a "T".

16. The golf putting club of claim 1, wherein said club head is made of a material formed from a mixture of aluminum and zinc.

17. The golf putting club of claim 16 wherein the ratio of said aluminum to said zinc is 70% to 30%.

18. The golf putting club of claim 16, wherein said material is ZA-12.

19. The golf putting club of claim 1, wherein said convex surface is formed from an arc having a radius of length between approximately 5 inches and 84 inches.

20. The golf putting club of claim 1, wherein said putting surface is smooth.

21. The golf putting club of claim 1, wherein said putting surface is roughened.

22. The golf putting club of claim 1, further comprising an alignment means to assist in aligning said putting surface for properly striking a ball.

23. The golf putting club of claim 22, wherein said alignment means comprises a line running generally parallel to said putting surface.

24. The golf putting club of claim 23, wherein said line is positioned to the rear of said putting surface.

* * * * *